US009596897B2

(12) United States Patent
Huff et al.

(10) Patent No.: US 9,596,897 B2
(45) Date of Patent: Mar. 21, 2017

(54) FLOCKED WAISTBAND

(71) Applicant: NIKE, Inc., Beaverton, OR (US)

(72) Inventors: Sebastian Huff, Portland, OR (US); Shawn D. Wenzel, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 804 days.

(21) Appl. No.: 13/751,456

(22) Filed: Jan. 28, 2013

(65) Prior Publication Data

US 2014/0208484 A1 Jul. 31, 2014

(51) Int. Cl.
*A41F 9/02* (2006.01)

(52) U.S. Cl.
CPC ..... *A41F 9/02* (2013.01); *A41F 9/025* (2013.01)

(58) Field of Classification Search
CPC ..... A41F 9/00; A41F 9/02; A41F 9/025
USPC ..... 2/78.3, 236, 237
See application file for complete search history.

(56) References Cited

U.S. PATENT DOCUMENTS 1,995,734 A 3/1935 Callahan
2,059,103 A * 10/1936 Hardie ..... A41F 9/02 2/237
2,095,387 A * 10/1937 Huizeng ..... D03D 7/00 139/384 R
2,290,238 A * 7/1942 Hickok ..... B05D 1/16 2/237
2,333,839 A * 11/1943 Blackburn ..... A61F 13/64 128/98.1
2,916,036 A * 12/1959 Sutton ..... A41D 19/0055 2/167
3,530,859 A * 9/1970 Heimowitz ..... A61F 13/49004 604/378
3,575,751 A 4/1971 Mizell
3,592,719 A 7/1971 Offray, Jr.
3,711,868 A * 1/1973 Kristof ..... A41F 9/00 2/237
4,180,606 A * 12/1979 Hance ..... D04H 11/00 118/200
4,267,219 A * 5/1981 Ueno ..... D06Q 1/14 428/327

(Continued)

FOREIGN PATENT DOCUMENTS

CN 202499976 U 10/2012
DE 7706980 6/1977

(Continued)

OTHER PUBLICATIONS

International Search Report and Written Opinion for International Application No. PCT/2014/013108, mailed Jun. 2, 2014.

*Primary Examiner* — Danny Worrell
(74) *Attorney, Agent, or Firm* — Shook, Hardy & Bacon L.L.C.

(57) ABSTRACT

A waistband for an article of apparel includes a base layer that is resiliently elastic and that includes an inner surface, an outer surface, and an upper edge. The waistband also includes a mounting layer that is resiliently elastic and that includes a first surface and a second surface. The first surface is layered over and attached to the inner surface, the outer surface, and the upper edge of the base layer. The waistband also includes flocking that is mounted on the second surface of the mounting layer. The flocking is disposed on the waistband to face a wearer of the article of apparel.

19 Claims, 5 Drawing Sheets

(56) References Cited

U.S. PATENT DOCUMENTS 4,372,998 A * 2/1983 Shimada ..... A41D 27/245 139/117
4,390,387 A * 6/1983 Mahn ..... B05D 1/16 156/273.1
4,438,533 A * 3/1984 Hefele ..... A41D 27/06 156/277
4,481,682 A * 11/1984 Hall ..... A41F 3/00 2/304
4,481,981 A * 11/1984 Motte ..... B60R 22/12 139/383 R
4,757,557 A * 7/1988 Hirano ..... A41D 19/0055 2/164
5,047,103 A 9/1991 Abrams
5,683,019 A * 11/1997 Schaber ..... A63B 47/001 224/191
5,981,021 A * 11/1999 McCulloch ..... D06M 17/04 428/90
6,029,282 A * 2/2000 Buschman ..... A42B 3/163 128/866
6,419,548 B1 * 7/2002 Wittes ..... A41C 3/065 2/267
6,977,023 B2 12/2005 Abrams
7,017,194 B2 * 3/2006 Schroth ..... A42B 3/0473 2/410
7,581,258 B2 * 9/2009 Baron ..... A41D 31/0033 2/168
8,128,457 B2 * 3/2012 Reinisch ..... A41C 3/0057 450/39
2001/0008672 A1 * 7/2001 Norvell ..... A41B 11/005 428/90
2006/0010559 A1 * 1/2006 Hamlet ..... A41B 1/08 2/117
2006/0080755 A1 4/2006 Baron et al.
2009/0271914 A1 11/2009 Bauer
2010/0275344 A1 11/2010 Demarest et al.

FOREIGN PATENT DOCUMENTS

EP 0210304 2/1987
EP 2594670 A2 5/2013
FR 2808972 5/2000
GM 7706980 6/1977

* cited by examiner

FLOCKED WAISTBAND

FIELD

The present disclosure relates to a waistband and, more particularly, relates to a flocked waistband.

BACKGROUND

This section provides background information related to the present disclosure which is not necessarily prior art.

Various types of elastic waistbands have been proposed for retaining pants, shorts, and other garments on the waist of the wearer. Specifically, the waistband can be an annular member that is attached to the garment and that is resiliently elastic. The waistband can be slightly smaller in diameter than the wearer's waist such that, when the waistband is worn, the wearer's waist can resiliently expand the waistband in a radially outward direction. As a result, the waistband can bias radially inward to hold the garment to the wearer's waist.

SUMMARY

This section provides a general summary of the disclosure, and is not a comprehensive disclosure of its full scope or all of its features.

A waistband for an article of apparel is disclosed that includes a base layer that is resiliently elastic and that includes an inner surface, an outer surface, and an upper edge. The waistband also includes a mounting layer that is resiliently elastic and that includes a first surface and a second surface. The first surface is layered over and attached to the inner surface, the outer surface, and the upper edge of the base layer. The waistband also includes flocking that is mounted on the second surface of the mounting layer. The flocking is disposed on the waistband to face a wearer of the article of apparel.

Also, an article of apparel is disclosed that includes a shell configured to cover a pelvic region of a wearer of the article of apparel. The apparel also includes a waistband that is coupled to the shell to extend in a circumferential direction about a waist region of the wearer. The waistband is configured to support the article of apparel at the waist region. The waistband includes a resiliently elastic base layer with an inner surface, an outer surface, and an upper edge. The waistband also includes a resiliently elastic mounting layer. The mounting layer includes a first surface that is layered over and attached to the inner surface, the outer surface, and the upper edge of the base layer. The mounting layer also includes a second surface. Moreover, the waistband also includes a flocking that is mounted on the second surface of the mounting layer. The flocking is disposed on the waistband to face the waist region of the wearer.

Additionally, an article of apparel is disclosed that includes a shell configured to cover a pelvic region of a wearer. The apparel includes a waistband that is stitched to the shell to extend in a circumferential direction about a waist region of the wearer. The waistband also defines a transverse direction. The waistband is configured to resiliently stretch in the circumferential direction support the article of apparel at the waist region. The waistband includes a resiliently elastic base layer with an inner surface, an outer surface, and an upper edge. Also, the waistband includes a resiliently elastic mounting layer with a first surface that is layered over and adhesively attached to the inner surface, the outer surface, and the upper edge. The mounting layer also includes a second surface. Furthermore, the waistband includes flocking that is mounted on the second surface to face the waist region of the wearer. The flocking includes a first circumferential strip and a second circumferential strip that extend annularly and continuously in the circumferential direction. The flocking additionally includes a plurality of transverse strips that extend between the first and second circumferential strips in the transverse direction. A plurality of openings are defined between adjacent ones of the plurality of transverse strips and between the first and second circumferential strips. The second surface is exposed via the plurality of openings.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Figure 1:
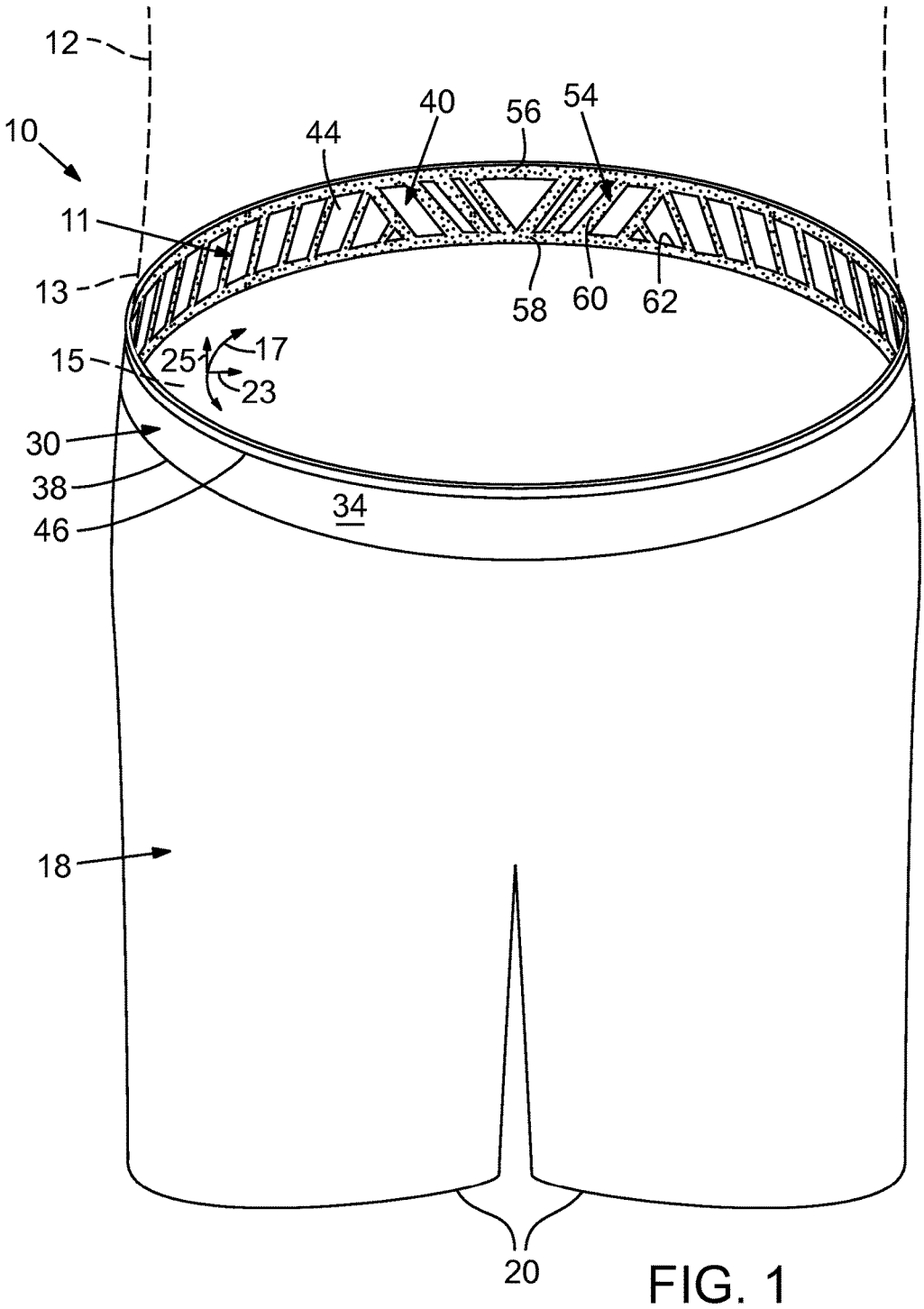
FIG. 1 is a front perspective view of an article of apparel with a flocked waistband according to exemplary embodiments of the present disclosure.

Referring initially to FIG. 1, an article of apparel 10 (i.e., garment, clothing, or other object worn on a wearer's body) is illustrated according to exemplary embodiments of the present disclosure. The apparel 10 can be worn by a wearer 12 (shown in phantom in FIG. 3). In the embodiments illustrated, the apparel 10 includes and/or defines a pair of shorts that is configured to be worn and at least partially cover a waist region 13 and pelvic region 15 (i.e., the buttocks, groin, thighs, and surrounding regions) of the wearer 12. However, it will be appreciated that the apparel 10 could be a pair of pants, a skirt, a belt, or any other type of apparel without departing from the scope of the present disclosure.

Generally, the apparel 10 can include a hollow, tubular shell 18 and a waistband 11 (i.e., a waistband assembly). The shell 18 can extend from the waistband 11 to cover the pelvic region 15 of the wearer 12 and can branch apart and terminate at separate cuffs 20. The waistband 11 can extend over the waist region 13 and/or surrounding area (at or above the hips, at or below the waist) of the wearer 12.

In the embodiments of FIG. 1, when the apparel 10 is worn, the waistband 11 can extend annularly and continuously about the waist region 13 of the wearer 12 in a circumferential direction 17. The waistband 11 can also extend in a transverse direction 25 (i.e., a thickness direction). Stated differently, the waistband 11 can be ring-shaped. The waistband 11 can extend only partially about the waist region 13 in the circumferential and transverse directions 17, 25 in additional embodiments.

In the embodiments of FIG. 1, the waistband 11 is removably attached to the shell 18 via a stitched hem, adhesives, etc. Stated differently, the waistband 11 can be independent of, but attached to the shell 18. In additional embodiments, at least portions of the waistband 11 can be integrally attached (e.g., knit or woven) with the shell 18 so as to be monolithic.

The width (diameter) of the waistband 11 can be slightly smaller than the waist size of the waist region 13 of the wearer 12. Also, one or more components of the waistband 11 can be resiliently elastic (i.e., stretchable) in the circumferential direction 17. Thus, when the apparel 10 is worn, the waist region 13 of the wearer 12 can push the waistband 11 outward in a radial direction 23 to thereby resiliently stretch the waistband 11 outwardly in the radial direction 23. As a result, the waistband 11 can bias the apparel 10 radially inward against the waist region 13 of the wearer 12 to retain the apparel 10 at the waist region 13.

Also, as will be discussed in detail, the waistband 11 can be very comfortable to wear by distributing pressure effectively and evenly on the wearer 12. The waistband 11 can also readily allow the wearer's perspiration to evaporate and/or move away from the waist region 13. Stated differently, the waistband 11 can be very breatheable. Furthermore, the waistband 11 can be visually appealing. The waistband 11 can include additional features that will be discussed below.

Referring now to FIGS. 1-5, the waistband 11 will be discussed in detail. The waistband 11 can include a base layer 30. The base layer 30 can be a flat, elongate panel of resiliently elastic material, such as a synthetic knit fabric. The base layer 30 can be annular and belt-shaped so as to include an inner surface 32, an outer surface 34, an upper edge 36, and a lower edge 38. The inner surface 32 can be configured to face the waist region 13 of the wearer 12. The outer surface 34 can face in an opposite direction. The upper edge 36 can be defined above the lower edge 38 in the transverse direction 25.

The elasticity of the base layer 30 can allow the base layer 30 to stretch (elongate) in the circumferential direction 17 and to recover such that the base layer 30 biases toward the wearer 12 in the radial direction 23. In some embodiments, the base layer 30 lies substantially flat (without bunching up or pleating) due to the material thickness, the elasticity, and the amount of material of the base layer 30.

The waistband 11 can also include a mounting layer 40. The mounting layer 40 can be a flat, elongate panel of resiliently elastic material, such as a synthetic knit fabric. In some embodiments, the mounting layer 40 can be made from the same material and/or the same knit as the base layer 30. The mounting layer 40 can include a first surface 42, a second surface 44, a first edge 46, and a second edge 48.

Figure 4:
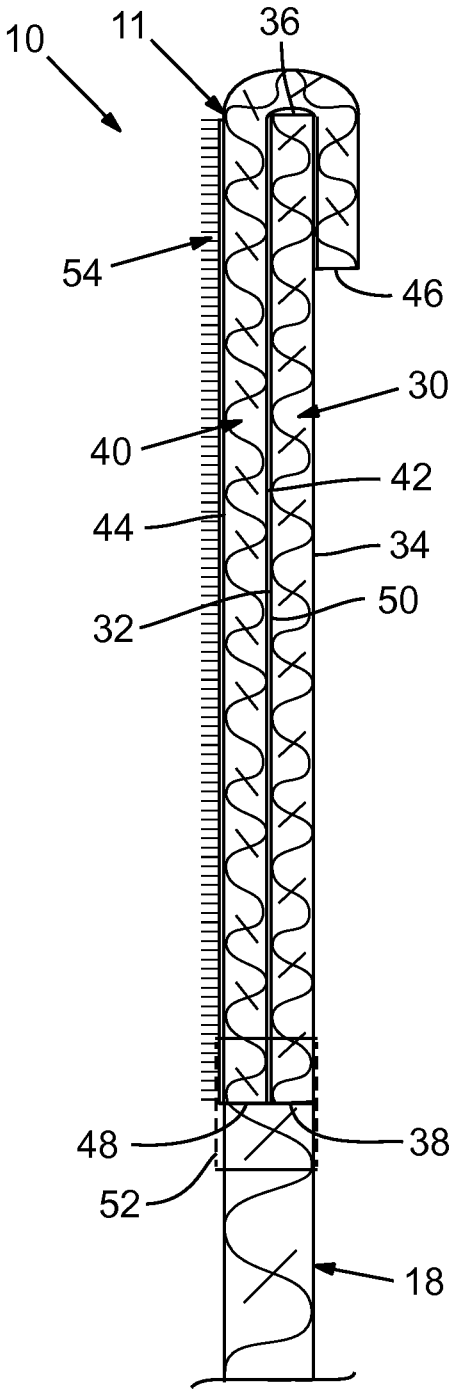
FIG. 4 is a section view of the article of apparel of taken along the line 4-4 of FIG. 3.
Figure 5:
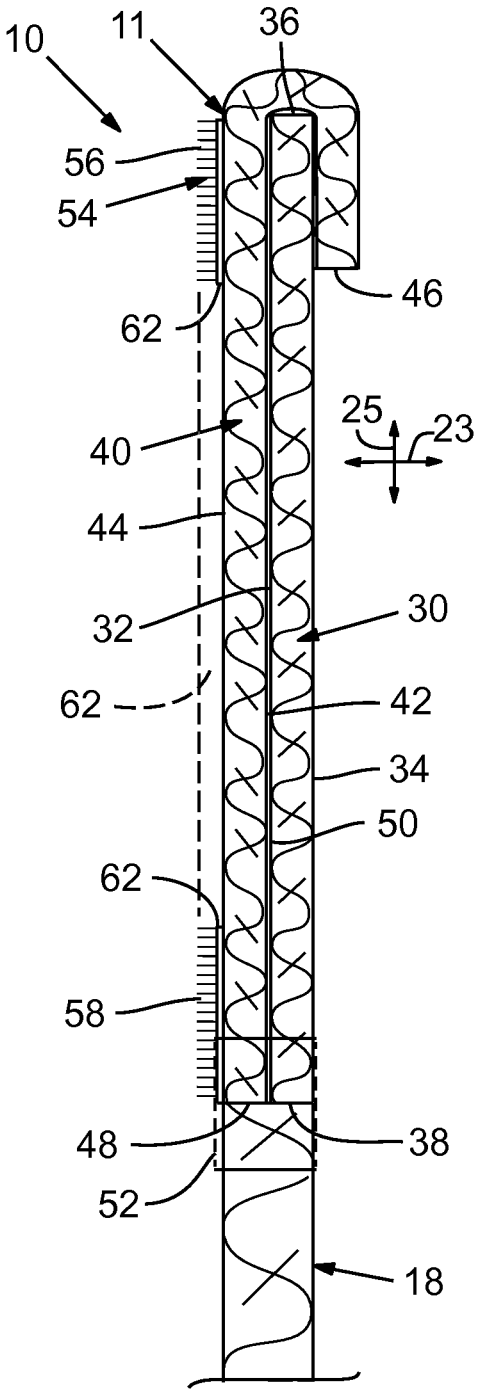
FIG. 5 is a section view of the article of apparel of taken along the line 5-5 of FIG. 3.

The mounting layer 40 can be layered over and attached to the base layer 30. For instance, as shown in FIGS. 4 and 5, the first surface 42 can face the base layer 30, and the second surface 44 can face opposite from the first surface 42. Also, the mounting layer 40 can extend upward in the transverse direction 25 and fold over the upper edge 36 of the base layer 30 such that the first edge 46 is disposed over the outer surface 34 of the base layer 30. The second edge 48 can be disposed substantially adjacent the lower edge 38 of the base layer 30.

The elasticity of the mounting layer 40 can allow the mounting layer 40 to stretch (elongate) in the circumferential direction 17 and to recover such that the mounting layer 40 biases toward the wearer 12 in the radial direction 23. In some embodiments, the mounting layer 40 biases radially inward and can lie substantially flat against the wearer 12 (without bunching up or pleating) due to the material thickness, the elasticity, and the amount of material of the mounting layer 40. Also, the mounting layer 40 can have resiliency that compliments that of the base layer 30. For instance, the mounting layer 40 and base layer 30 can have substantially the same resiliency, stiffness, resistance to stretching, etc. Accordingly, the mounting layer 40 and base layer 30 can comfortably and effectively retain the waistband 11 at the waist region 13.

In some embodiments, the first surface 42 of the mounting layer 40 is adhesively attached to the inner surface 32 of the base layer 30 via an adhesive layer 50 (FIGS. 4 and 5). The adhesive layer 50 can be an adhesive tape that is made from a thermoplastic material. The adhesive layer 50 can also have substantially the same dimensions (e.g., same length and width) as the first surface 42 of the mounting layer 40. In some embodiments, the adhesive tape can be of a type that is commercially available from Bemis Associates, Inc. of Shirley, Mass. Thus, the adhesive layer 50 can also be resiliently elastic to allow the waistband 11 to resiliently stretch as discussed above. It will be appreciated, however, that the mounting layer 40 and base layer 30 could be attached via stitching (e.g., elastic yarns), fasteners, etc. without departing from the scope of the present disclosure.

The mounting layer 40 and base layer 30 can be attached to the shell 18 of the apparel 10 in any suitable fashion. In some embodiments, the mounting layer 40 and base layer 30 can be attached via stitching 52. The stitching 52 can have any suitable configuration (e.g., zig-zag stitch, etc.). The stitching 52 can extend in the transverse direction 25 and in the radial direction 23 and can extend through the thickness of the mounting layer 40, base layer 30, and shell 18.

The waistband 11 can further include flocking 54. The flocking 54 can include a plurality of relatively short fibers (e.g., 0.5 to 1 millimeter) that extend inward from the second surface 44 and terminate in the radial direction 23 (see FIGS. 4 and 5). Accordingly, the flocking 54 can have a comfortable, velvety feel against the skin of the wearer 12.

Figure 2:
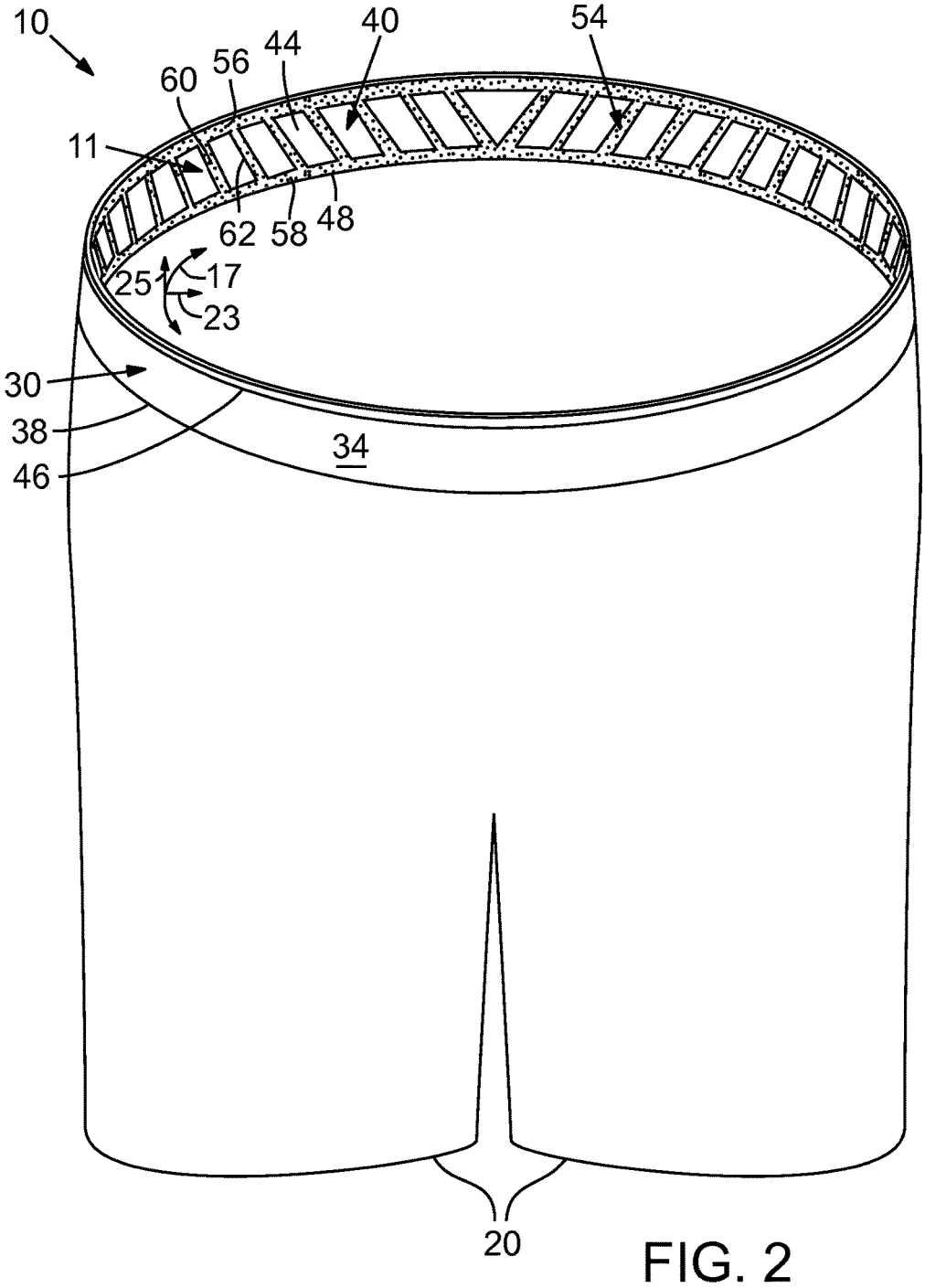
FIG. 2 is a rear perspective view of the article of apparel of FIG. 1.
Figure 3:
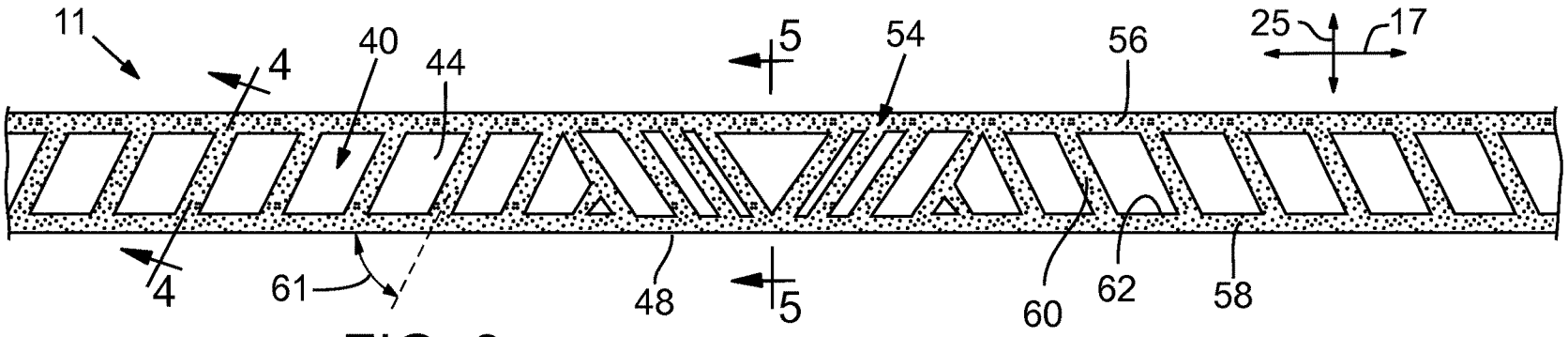
FIG. 3 is a plan view of an interior surface of the waistband of the article of apparel of FIG. 1.

In the embodiments illustrated in FIGS. 1-3, the flocking 54 can be patterned so as to be aesthetically pleasing. For instance, the flocking 54 can include a first circumferential strip 56 that extends continuously and annularly in the circumferential direction 17. The flocking 54 can also include a second circumferential strip 58 that extends continuously and annularly in the circumferential direction 17. The first and second circumferential strips 56, 58 can be spaced away from each other in the transverse direction 25. Moreover, the flocking 54 can include at least one transverse strip 60. For instance, the flocking 54 can include a plurality of transverse strips 60 that are linear and that have a substantially uniform width. The transverse strips 60 can extend between the first and second circumferential strips 56, 58 at an acute angle 61 (FIG. 3) in some embodiments. Also, as shown in FIG. 3, a plurality of polygonal (e.g., triangular, rectangular, etc.) openings 62 are defined by the pattern of the flocking 54. As shown in FIG. 5, the second surface 44 of the mounting layer 40 can be exposed via the openings 62. It will also be appreciated that the flocking 54 could be more continuous in some embodiments and/or could be patterned in any suitable fashion without departing from the scope of the present disclosure.

Thus, the waistband 11 can be very comfortable to wear, can be aesthetically pleasing, can effectively retain the waistband 11 at the waist region 13, etc. For instance, the waistband 11 can be relatively thin in the radial direction 23 and can resist bunching and pleating. Also, the waistband 11 can lie flat and can evenly distribute pressure across the waist region 13. Moreover, the flocking 54 can be visually pleasing and can provide a cushioned and breathable fit about the waist region 13.

Figure 6:
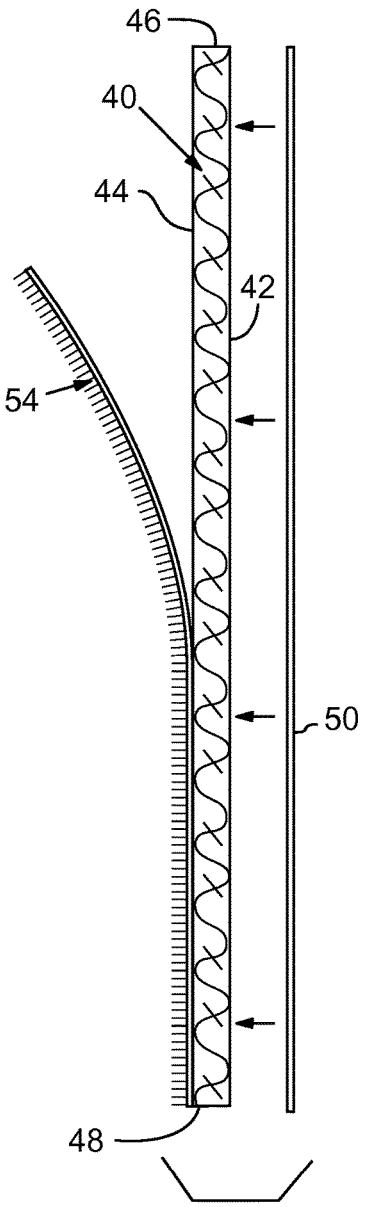
FIG. 6 is a section view of portions of the article of apparel during assembly.

FIGS. 6-9 illustrate various embodiments of manufacturing the article of apparel 10. As shown in FIG. 6, the adhesive layer 50 can be applied on the first surface 42 of the mounting layer 40. Also, the flocking 54 can be applied onto the second surface 44 of the mounting layer 40 (e.g., by using an applique, a silkscreening method, or any suitable transfer method).

Figure 7:
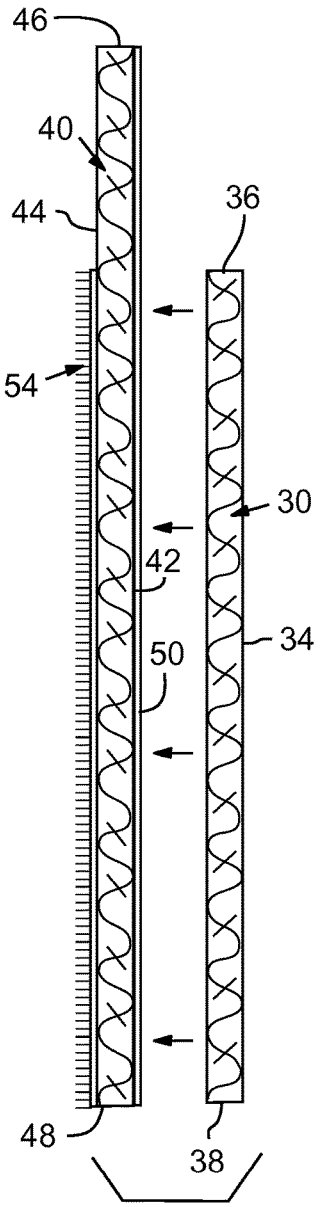
FIG. 7 is a section view of portions of the article of apparel during assembly.
Figure 8:
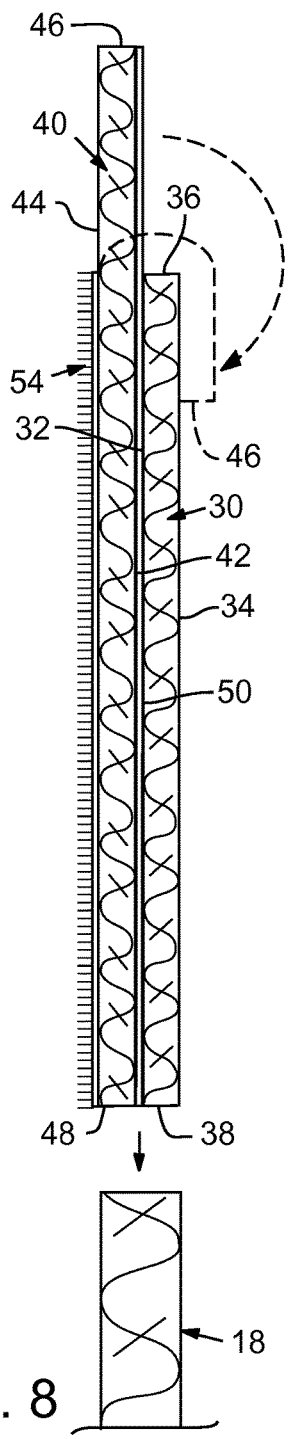
FIG. 8 is a section view of portions of the article of apparel during assembly.

Then, as shown in FIG. 7, the base layer 30 can be adhered to the adhesive layer 50. Next, as shown in FIG. 8, the first edge 46 of the mounting layer 40 can be folded over to the outer surface 34 of the base layer 30. Heat and pressure can be applied to ensure adhesion of the adhesive layer 50 to both the base layer 30 and mounting layer 40 and to attach the first surface 42 to each of the inner surface 32, the upper edge 36, and the outer surface 34. For instance, the pressure can be applied between 40 psi to 60 psi for 20 to 30 seconds while heat is applied between 150° F. and 170° F. Additionally, the waistband 11 can be attached to the shell 18 via the stitching 52, etc.

Accordingly, the waistband 11 can be manufactured in an efficient manner. However, it will be appreciated 11 that methods of manufacturing the waistband 11 can vary from the embodiments described above and shown in FIGS. 6-8.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A waistband for an article of apparel, the waistband comprising:

a base layer that is resiliently elastic and that includes an inner surface, an outer surface, and an upper edge;

a mounting layer that is resiliently elastic and that includes a first surface and a second surface, the first surface being layered over and attached to the inner surface of the base layer, a portion of the outer surface of the base layer, and the upper edge of the base layer, a remaining portion of the outer surface of the base layer that is not covered by the mounting layer being exposed; and a flocking that is mounted on the second surface of the mounting layer, the flocking disposed on the waistband to face a wearer of the article of apparel.

2. The waistband of claim 1, wherein at least a portion of the flocking extends continuously and annularly about the waistband in a circumferential direction.

3. The waistband of claim 1, wherein the flocking includes at least one opening, such that the second surface of the mounting layer is exposed at the at least one opening.

4. The waistband of claim 3, wherein the at least one opening is polygonal.

5. The waistband of claim 1, wherein the waistband defines a circumferential direction and a transverse direction that is transverse to the circumferential direction, wherein the flocking includes a first circumferential strip and a second circumferential strip that each extend continuously and annularly in the circumferential direction, the first and second circumferential strips being spaced from each other in the transverse direction, and wherein the flocking includes at least one transverse strip that extends between the first circumferential strip and the second circumferential strip in the transverse direction.

6. The waistband of claim 5, wherein the at least one transverse strip extends between the first and the second circumferential strips at an acute angle.

7. The waistband of claim 5, wherein the at least one transverse strip includes a plurality of transverse strips that are spaced apart from each other in the circumferential direction.

8. The waistband of claim 1, wherein the base layer and the mounting layer are adhesively attached via a resiliently elastic adhesive tape.

9. An article of apparel, comprising:

a shell configured to cover a pelvic region of a wearer of the article of apparel; and a waistband that is coupled to the shell and extends in a circumferential direction about a waist region of the wearer, the waistband configured to support the article of apparel at the waist region, the waistband including a resiliently elastic base layer with an inner surface, an outer surface, and an upper edge, the waistband also including a resiliently elastic mounting layer, the mounting layer including a first surface that is layered over and attached to the inner surface, the outer surface, and the upper edge of the base layer, the mounting layer also including a second surface, the waistband also including a flocking mounted on the second surface of the mounting layer, the flocking disposed on the waistband to face the waist region of the wearer, wherein the flocking is configured to define a plurality of openings through which the second surface of the mounting layer is exposed to face the waist region of the wearer.

10. The article of apparel of claim 9, wherein the flocking comprises first and second circumferential strips that extend circumferentially and annularly about the waistband, and wherein the flocking further comprises at least one transverse strip extending between the first and second circumferential strips.

11. The article of apparel of claim 9, wherein the plurality of openings comprise a variety of shapes.

12. The article of apparel of claim 9, wherein the mounting layer is adhesively attached to at least one of the inner surface, the upper edge, and the outer surface via a resiliently elastic adhesive tape.

13. The article of apparel of claim 9, wherein at least a portion of the flocking extends continuously about the waistband in the circumferential direction.

14. The article of apparel of claim 9, wherein at least a portion of the outer surface of the base layer is not covered by the mounting layer and exposed to face away from the waist region of the wearer.

15. The article of apparel of claim 9, wherein at least a portion of the plurality of openings are polygonal.

16. The article of apparel of claim 9, wherein the flocking comprises first and second circumferential strips that extend circumferentially and annularly about the waistband and at least one transverse strip extending between the first and second circumferential strips, the first and second circumferential strips being spaced from each other in a transverse direction.

17. The article of apparel of claim 16, wherein the at least one transverse strip extends between the first and the second circumferential strips at an acute angle.

18. The article of apparel of claim 16, wherein the at least one transverse strip includes a plurality of transverse strips that are spaced apart from each other in the circumferential direction.

19. An article of apparel comprising:

a shell configured to cover a pelvic region of a wearer of the article of apparel; and a waistband that is stitched to the shell to extend in a circumferential direction about a waist region of the wearer, the waistband also defining a transverse direction, the waistband configured to resiliently stretch in the circumferential direction and support the article of apparel at the waist region, the waistband including:

a resiliently elastic base layer with an inner surface, an outer surface, and an upper edge, a resiliently elastic mounting layer with a first surface that is layered over and adhesively attached to the inner surface, the outer surface, and the upper edge, the mounting layer also including a second surface, a flocking that is mounted on the second surface to face the waist region of the wearer, the flocking including a first circumferential strip and a second circumferential strip that extend annularly and continuously in the circumferential direction, the flocking also including a plurality of transverse strips that extend between the first and second circumferential strips in the transverse direction, a plurality of openings defined between adjacent ones of the plurality of transverse strips and between the first and second circumferential strips, the second surface being exposed via the plurality of openings.

* * * * *